US005740844A

United States Patent [19]

Miller

[11] Patent Number: 5,740,844

[45] Date of Patent: Apr. 21, 1998

[54] FILL SYSTEM INCLUDING A FILL VALVE HOUSING WITH INTERCHANGEABLE SANITARY COVER AND CLEAN-IN-PLACE MANIFOLD

[75] Inventor: Rodney W. Miller, Princeton, Minn.

[73] Assignee: Tetra Laval Holdings & Finance S.A., Pully, Switzerland

[21] Appl. No.: 636,580

[22] Filed: Apr. 23, 1996

[51] Int. Cl.[6] ..... B65B 1/04

[52] U.S. Cl. ..... 141/90; 141/129; 222/148; 134/166 R

[58] Field of Search ..... 141/90, 91, 92, 141/237, 129, 182, 186; 222/148; 134/166 R, 169 R, 171

[56] References Cited

U.S. PATENT DOCUMENTS

| | | | |
|---|---|---|---|
| 3,464,436 | 9/1969 | Bruning . | |
| 3,714,956 | 2/1973 | Nelson . | |
| 4,339,111 | 7/1982 | Welch . | |
| 4,417,610 | 11/1983 | Waldstrom et al. | 141/91 |
| 4,745,944 | 5/1988 | Francart, Jr. . | |
| 4,913,202 | 4/1990 | Miller et al. . | |
| 4,964,444 | 10/1990 | Hanérus et al. . | |
| 5,069,366 | 12/1991 | Graffin . | |
| 5,348,058 | 9/1994 | Ruhl . | |
| 5,531,253 | 7/1996 | Nishiyama et al. | 141/90 |

*Primary Examiner*—Henry J. Recla
*Assistant Examiner*—Steven O. Douglas
*Attorney, Agent, or Firm*—McAndrews, Held & Malloy, Ltd.; Michael A. Catania

[57] ABSTRACT

A filling system is set forth that assists in providing fast and simple configuration of a fill system of a packaging machine between its configuration during a production cycle of the machine and its configuration during a clean-in-place cycle of the machine. The filling system comprises a valve housing having a flow channel, an inlet to the flow channel, and an outlet from the flow channel. The valve housing has a flange extending therefrom about at least a portion of the periphery of the valve housing. A valve member is disposed in the valve housing for controlling fluid flow from the outlet of the valve housing. A clean-in-place manifold is also provided for use during a clean-in-place operation of the packaging machine. The clean-in-place manifold has an inlet and an outlet and a flange disposed about at least a portion of the periphery of the inlet of the manifold. A sanitary cover is provided for use during a production cycle of the machine. The sanitary cover comprises a shield portion and a securement portion. The securement portion comprises a collar extending from the shield portion and a flange disposed about at least a portion of the periphery of the collar. A tri-clamp is also provided and has a groove disposed therein for alternately securing the flange of the clean-in-place manifold to the flange of the valve housing and the flange of the sanitary cover to the flange of the valve housing.

14 Claims, 8 Drawing Sheets

FILL SYSTEM INCLUDING A FILL VALVE HOUSING WITH INTERCHANGEABLE SANITARY COVER AND CLEAN-IN-PLACE MANIFOLD

TECHNICAL FIELD

The present invention relates to a fill system that may be readily configured for production and clean-in-place processes. More specifically, the present invention relates to a fill system including a valve housing and a readily interchangeable sanitary cover and clean-in-place manifold

BACKGROUND

In the packaging trade it is customary to pack contents of liquid foodstuffs, e.g. milk, in finished non-returnable consumer packages. Packaging of the foodstuffs most often is done with the help of modern packaging machines which, at a high rate of production, manufacture filled, sealed packages under hygienically acceptable production conditions. One such machine is sold by Tetra Rex Packaging Systems, Inc., under the trademark TETRA MINI or TR/MINI. Such a packaging machine operates to form, fill and seal gabled-top packages from prefabricated, sheet-like blanks of a suitable material, usually plastic-coated paper. In this process, flattened blanks are first erected to form open, tubular cartons of generally rectangular cross-section. The blanks are then conveyed to a first forming station of the machine which closes and seals one end of each carton. The first forming station of the machine generally comprises an intermittently rotating wheel with radial mandrels. The radial mandrels are adapted to receive the cartons in the correct feed position for the stepwise transport of the same through a number of base-forming, shaping and sealing stations located about the mandrel wheel. Once the ends are sealed, the cartons are removed from the mandrels and placed on a conveyor belt which is advanced synchronously with the indexing rotation of the mandrel wheel and which conveys the cartons to the filling station of the machine where the cartons are filled with suitable portions of product.

The filling stations usually comprise a vertical product fill pipe disposed in a separate machine casing. The fill pipe is connected to receive product from a product supply tank through a product supply pipe and metering pump. The metering pump is controlled to pump a predetermined volume of product through the product fill pipe and into the cartons advanced centrally below the product fill pipe. From the filling station the filled cartons are conveyed to a final forming station of the machine where the cartons, by means of forming and sealing operations, are given a liquid-tight top closure. Thereafter, the cartons, in the form of finished consumer packages, are discharged from the machine for further distribution.

It is important that the packaging operations, especially in the case of foodstuff-type products, takes place under hygienically acceptable conditions. Among other things, this means that machine parts which come into direct contact with the contents should be protected as fully as possible, so as not to come into contact with the non-sterile environmental atmosphere of the machine. Additionally, the components of the machine that come into contact with the product must be capable of being periodically cleaned-in-place and sterilized to reduce the possibility of contaminating the product as it passes through the filling system. One such machine component requiring special care and attention is of course the product filling pipe.

U.S. Pat. No. 4,964,444, illustrates one manner in which the inventor thereof attempted to provide a hygienic environment for production and periodic cleaning-in-place. There, the product filling pipe is partially surround by a tubular casing. The tubular casing is shaped such that a free flow space is formed between the product filling pipe and the casing. The lower end of the casing facing towards the opening of the product filling pipe preferably is cut obliquely to expose the product filling pipe from one direction of view. The casing is adapted so that it can be closed with the aid of a detachable, complementarily shaped lid element to form a circulation container which substantially encloses the product filling pipe during a clean-in-place cycle of the machine. During such a cycle, cleaning solution is passed through the product filling pipe and exits into the circulation container whereby both the interior and exterior of the product filling pipe are cleaned.

Until now, altering the filling system configuration between its configuration during a production cycle and its configuration during a clean-in-place cycle has been laborious and time-consuming. This is due, in part, to the extensive steps required to attach and detach the complementary shaped lid element. Additionally, the foregoing system does not necessarily provide adequate hygienic protection of the containers and product during a production cycle.

SUMMARY OF THE INVENTION

A filling system is set forth that assists in overcoming many of the foregoing problems. The filling system comprises a valve housing having a flow channel, an inlet to the flow channel, and an outlet from the flow channel. The valve housing has a flange extending therefrom about at least a portion of the periphery of the valve housing. A valve member is disposed in the valve housing for controlling fluid flow from the outlet of the valve housing.

A clean-in-place manifold is provided for use during a clean-in-place operation of the packaging machine. The clean-in-place manifold has an inlet and an outlet and a flange disposed about at least a portion of the periphery of the inlet of the manifold.

A sanitary cover is provided for use during a production cycle of the machine. The sanitary cover comprises a shield portion and a securement portion. The securement portion comprises a collar extending from the shield portion and a flange disposed about at least a portion of the periphery of the collar.

A tri-clamp is provided for alternately securing the flange of the clean-in-place manifold to the flange of the valve housing and the flange of the sanitary cover to the flange of the valve housing. To this end, the tri-clamp is provided with a groove that simultaneously grips the flange of the housing and the flange of the other component to hold them fast to one another. Such an arrangement facilitates fast and simple configuration of the fill system between its configuration during a production cycle of the machine and its configuration during a clean-in-place cycle of the machine.

Other objects and advantages of the present invention will become apparent upon reference to the accompanying detailed description when taken in conjunction with the following drawings.

DETAILED DESCRIPTION OF THE PREFERRED EMBODIMENT

Figure 1:
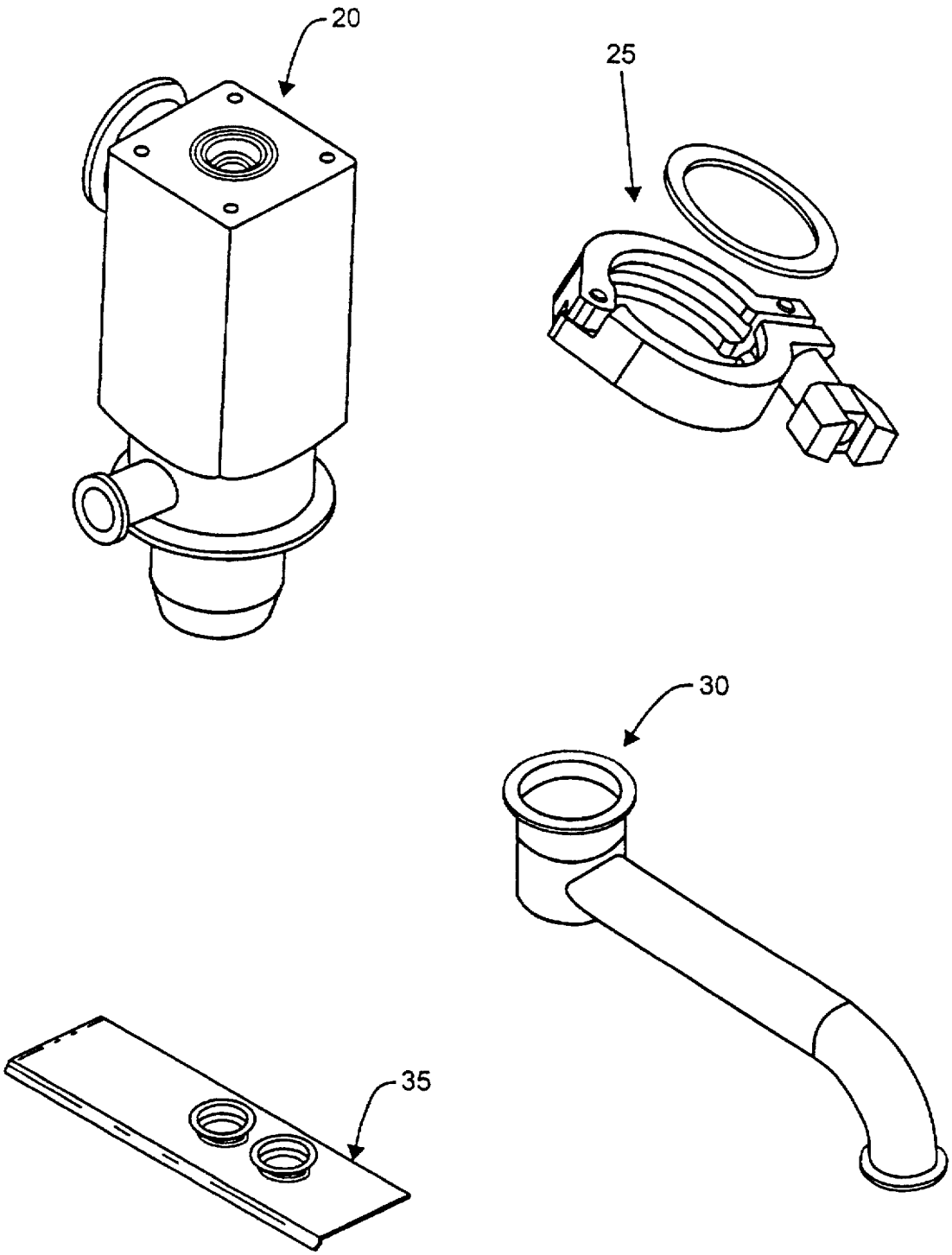
FIG. 1 are perspective views of one embodiment of each of the various components of the present invention.
Figure 2:
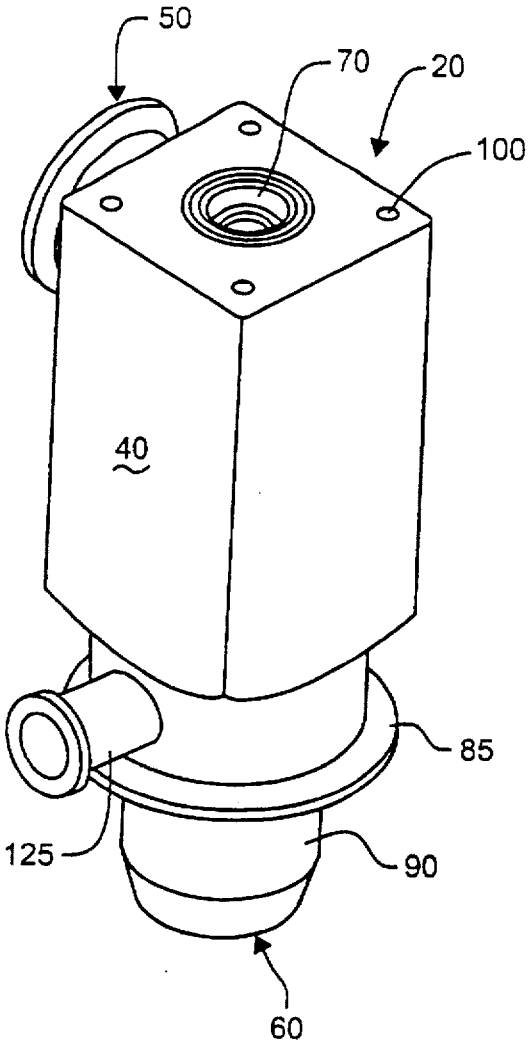
FIGS. 2–5 illustrate various views of one embodiment of the fill valve housing shown in FIG. 1.
Figure 3:
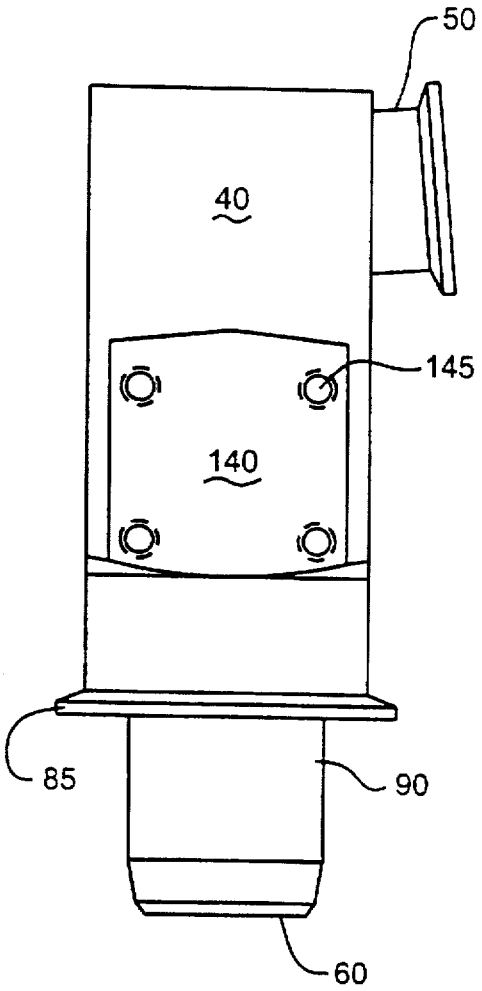

The basic components of one embodiment of a fill system constructed in accordance with the teachings of the present invention are set forth in FIG. 1. As illustrated, the basic components of the system comprise a fill valve housing 20, a tri-clamp 25, a clean-in-place manifold 30, and a sanitary cover 35.

With reference to FIGS. 2–5, there is shown one embodiment of a fill valve housing 20 suitable for use in the present system. As illustrated, the fill valve housing 20 includes a body portion 40 having a centrally disposed flow channel 45. An inlet 50 opens to the flow channel 45 and serves as a connection point to a supply of either a fluid product or of a cleaning fluid, depending upon the mode in which a filling machine incorporating the fill system is operating. The flow channel 45 opens to an outlet 55 having a valve seat 60.

A valve member 65 extends through the flow channel 45. The valve member 65 includes a valve stem 70 that extends through an aperture 75 disposed through the top portion of the body 40. A sliding o-ring 77 is disposed in the aperture 75. The valve stem 70 terminates in a valve plug 80 that, for example, is in the form of an umbrella cone. The valve plug 80 and valve seat 60 are formed so as to seal when they engage one another thereby to control the flow of a fluid from the flow channel 45. The valve stem 70 may engage, for example, a linear actuator that urges the valve member 65 between an open position in which fluid is allowed to flow from the fluid channel 45 and the closed position illustrated in FIG. 4.

A flange 85 is disposed about at least a portion of the periphery of the body 40 and, preferably, about the entire periphery thereof. A channel 87 is disposed in the flange 85 to accommodate a gasket, or the like. In the disclosed embodiment, the body terminates in a nozzle portion 90 proximate the outlet 55 that extends from the flange 85.

Figure 4:
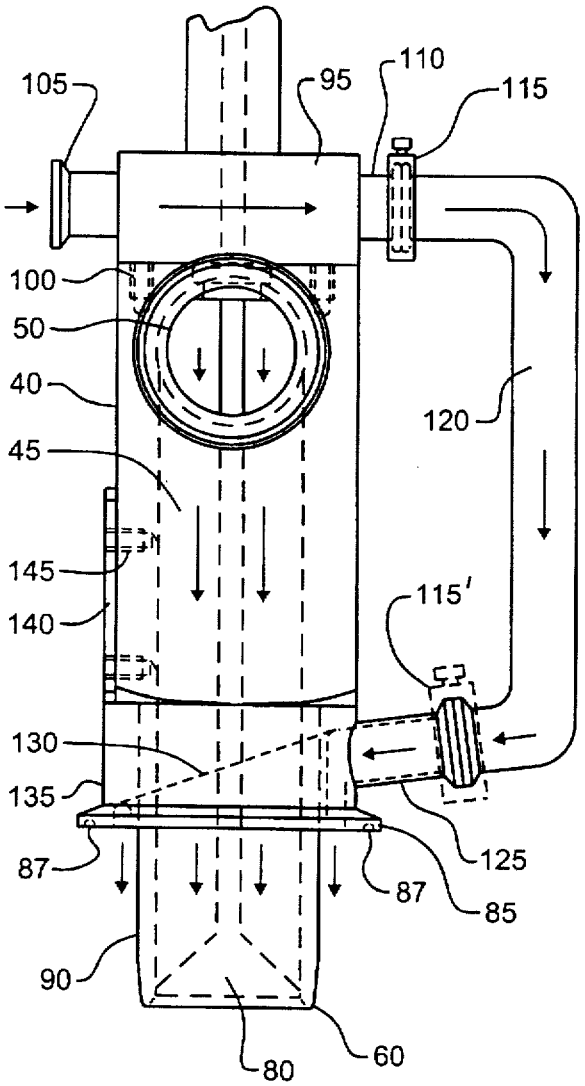
Figure 5:
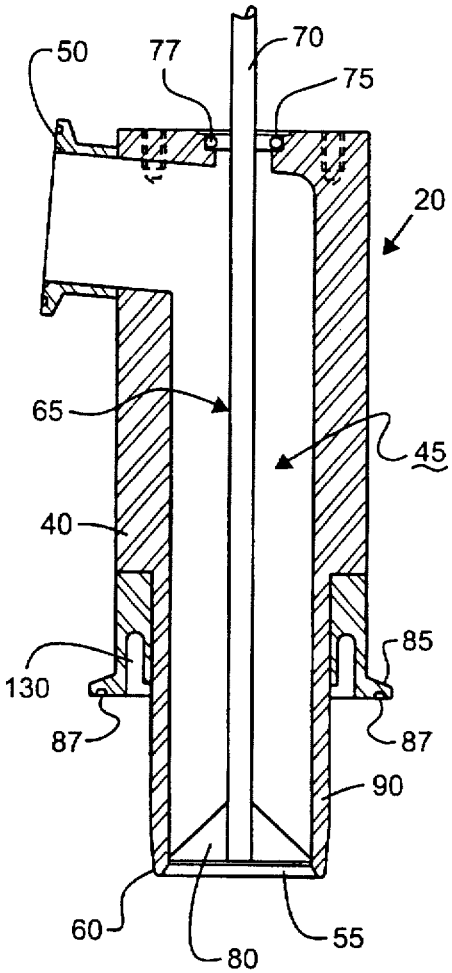
Figure 9:
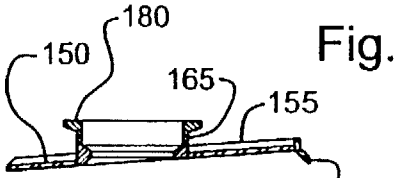
FIGS. 6–10 illustrate various views of one embodiment of the sanitary cover shown in FIG. 1.
Figure 7:
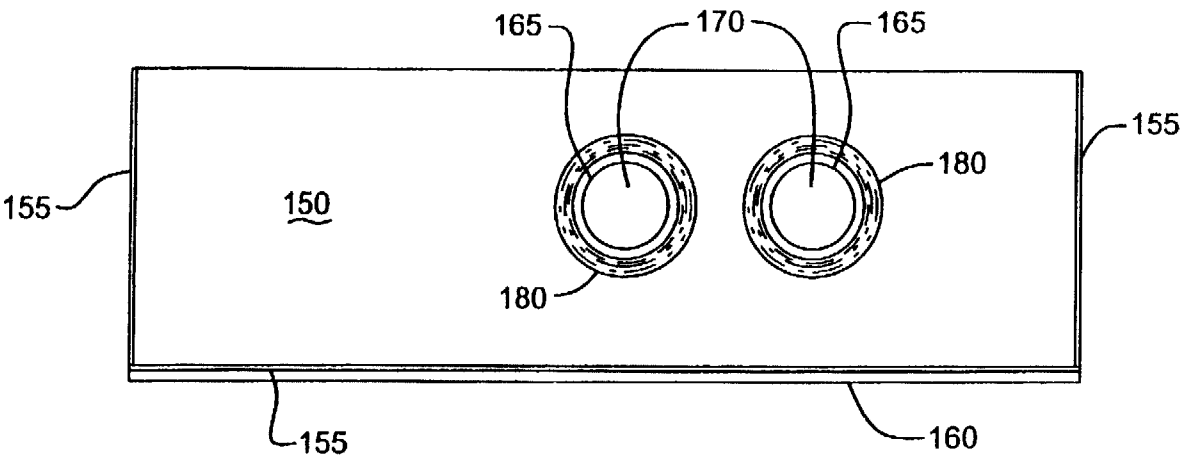
Figure 6:
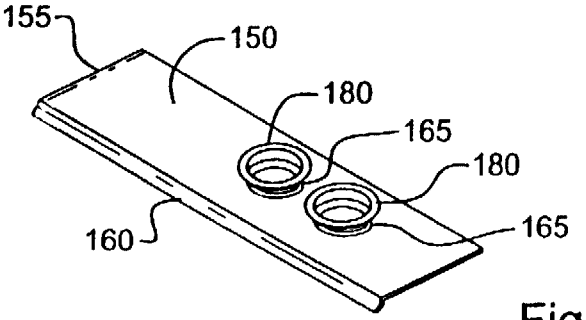
Figure 10:
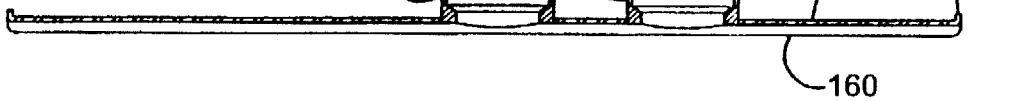
Figure 8:
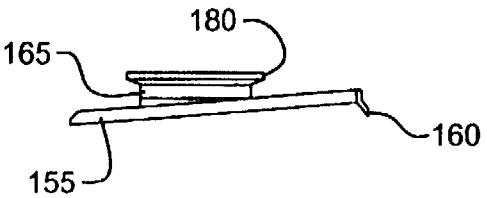
Figure 13:
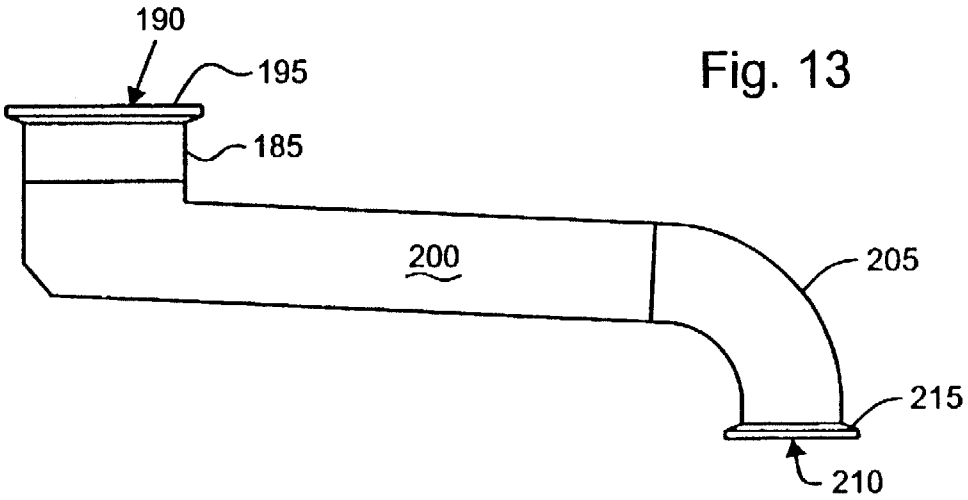
FIGS. 11–14 illustrate various views of one embodiment of the clean-in-place manifold shown in FIG. 1.
Figure 14:
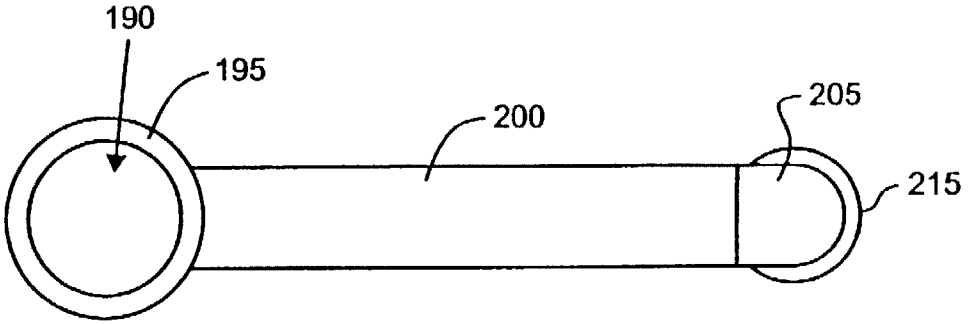
Figure 12:
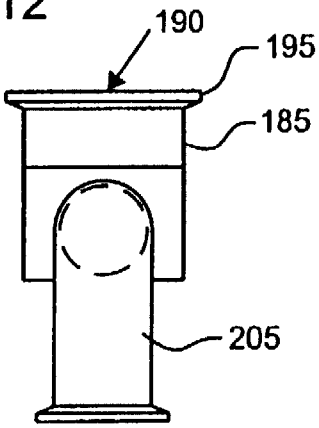
Figure 11:
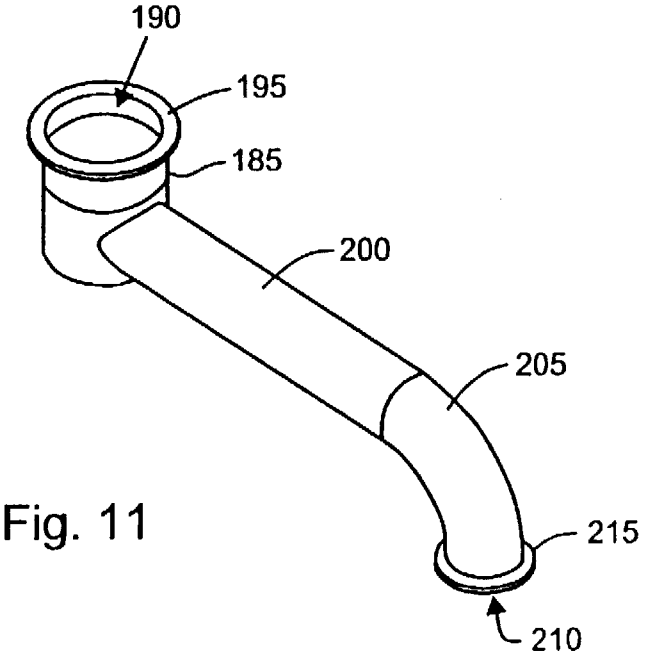

With reference to FIG. 4, there is shown a series of components that define a fluid path through which sterile air is passed during a production cycle of the packaging machine and through which a cleaning solution is passed during a clean-in-place cycle of the machine. As illustrated, a manifold 95 is disposed on top of the fill valve housing 40 and is secured by, for example, fasteners disposed through connection bores 100. The manifold 95 includes an inlet 105 that accepts sterile air from a sterile air supply (not illustrated) during a production cycle and accepts a cleaning solution from a cleaning solution supply during a clean-in-place cycle. The manifold 95 further includes an outlet 110 that is connected, for example, by a tri-clamp 115, to an intermediate pipe 120. The end of the intermediate pipe 120 opposite manifold 95 is connected by a tri-clamp 115' to an inlet 125 that provides a portal for communicating fluid to a channel 130 that is disposed in the body 40. The channel 130, for example, is disposed about the circumference of the nozzle portion 90 and is opened toward the outlet 55 and, for example, is tapered between the side of inlet 125 and side 135.

The fluid path for the sterile air and cleaning fluid is illustrated by arrows in FIG. 4. Fluid entering inlet 105 is communicated into manifold 95 and out of outlet 110. The fluid exiting outlet 110 is communicated through the intermediate pipe 120 to the inlet 125 of the channel 130 where it exits to surround the nozzle 90. In this manner, the product and container into which the product is dispensed are surrounded by sterile air during a production cycle while critical components are cleaned by circulating cleaning solution during a clean-in-place cycle.

The body 40 of the fill valve housing 20 is provided with components that assist in mounting the fill valve housing 20 within a filling machine. In the exemplary embodiment illustrated here, a mounting plate 140 is provided at one side of the body 40. The mounting plate 140 includes one or more apertures 145 that accommodate fasteners, such as bolts, therethrough to thereby facilitate securement of the fill valve housing 40 and, for example, the frame of the filling machine.

One embodiment of a sanitary cover 35 suitable for use in the present fill system is illustrated in FIGS. 6–10. As illustrated, the sanitary cover 35 includes a shield portion 150 that, for example, is generally planar and rectangular and is angled. An upwardly extending lip 155 extends along three sides of the shield portion 150. A downwardly turned lip 160 extends along one side of the shield portion 150. Two circular collars 165 extend upwardly, each defining an aperture 170 through the cover 35. A flange 180 extends about at least a portion of the periphery, and preferable about the entire periphery, of each collar 165. As will be manifest from subsequent functionality of the sanitary cover 35, only one aperture 170 and corresponding collar 170 and flange 180 need be utilized.

One embodiment of a clean-in-place manifold 30 suitable for use in the present fill system is illustrated in FIGS. 11–14. The clean-in-place manifold 30 includes an inlet 185 that, for example, may be in the form of an open-ended cylinder. A mouth portion 190 of the inlet 185 is defined by a flange 195 that extends about at least a portion of, and preferably, the entire periphery of the mouth 190. A lower portion of the inlet opens to a transverse flow pipe 200 that, in turn, engages an elbowed outlet 205. The elbowed outlet 205 includes a mouth 210 about which a flange 215 is disposed.

Figure 15:
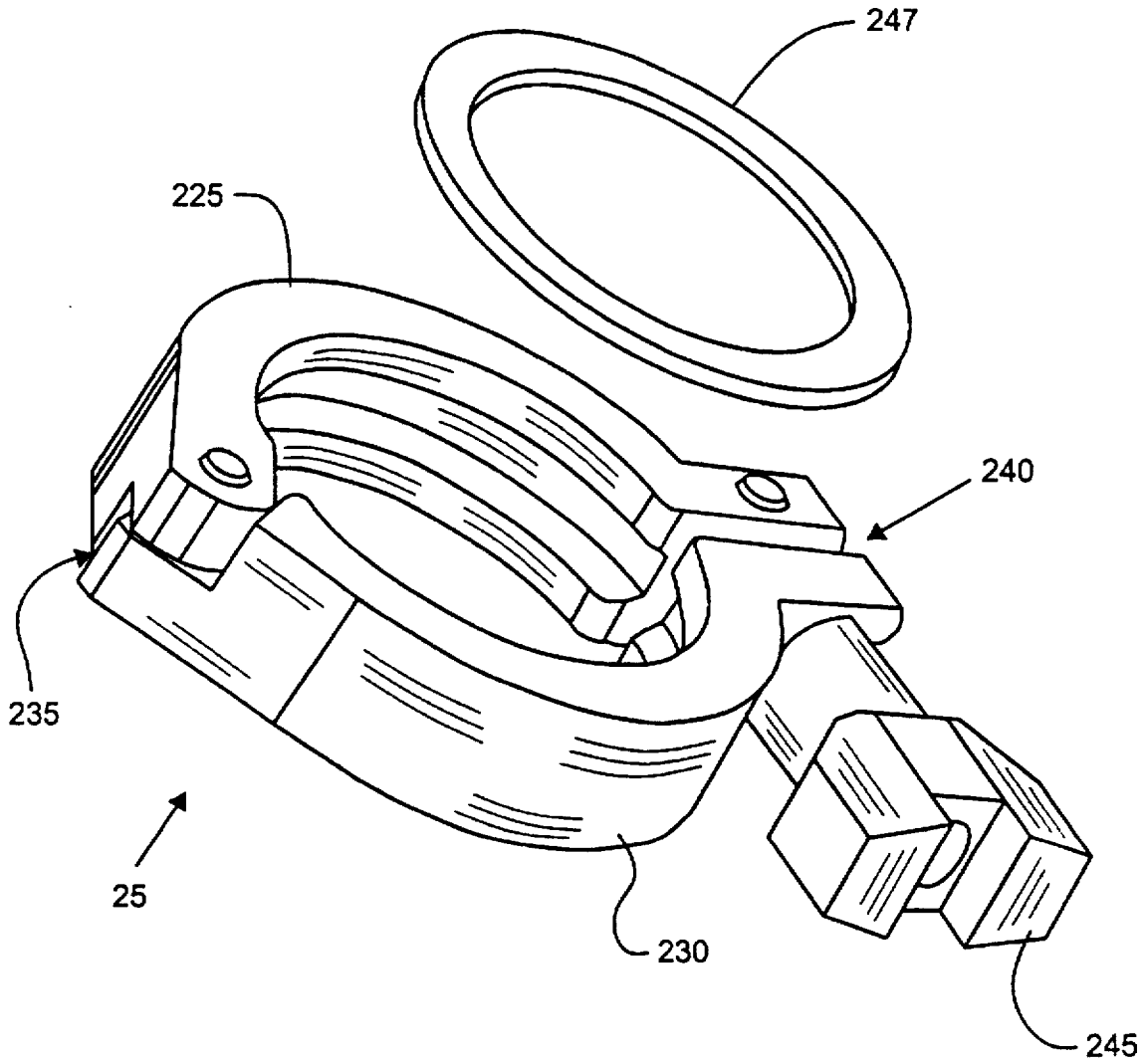
FIG. 15 is a perspective view of one embodiment of the tri-clamp shown in FIG. 1.

FIG. 15 illustrates one embodiment of a quick-clamp device, for example, a tri-clamp 25 suitable for use in the present fill system. The tri-clamp 25 is generally round and comprises two semicircular halves 225 and 230. The halves 225 and 230 are joined at a first side by a hinged joint 235 and at a second side by a releasable fastening mechanism 240. The releasable fastening mechanism 240 includes, for example, a screw-type fastener 245 that may be quickly turned by hand, or with the aid of a screw driver or the like, to secure the ends of the halves 225 and 230 together. The two semicircular halves 225 and 230 also define a channel 250. Channel 250 is dimensioned with respect to the flange 85 of the fill valve housing 20, the flange 195 of the clean-in-place manifold 30, and the flange 180 of the sanitary cover 35, so that the fill valve housing 20 may be alternately secured by the tri-clamp 25 to either the sanitary cover 35 or the clean-in-place manifold 30. In each instance, a gasket 247 engages channel 87 to ensure a proper seal between the joined flanges.

Figure 16:
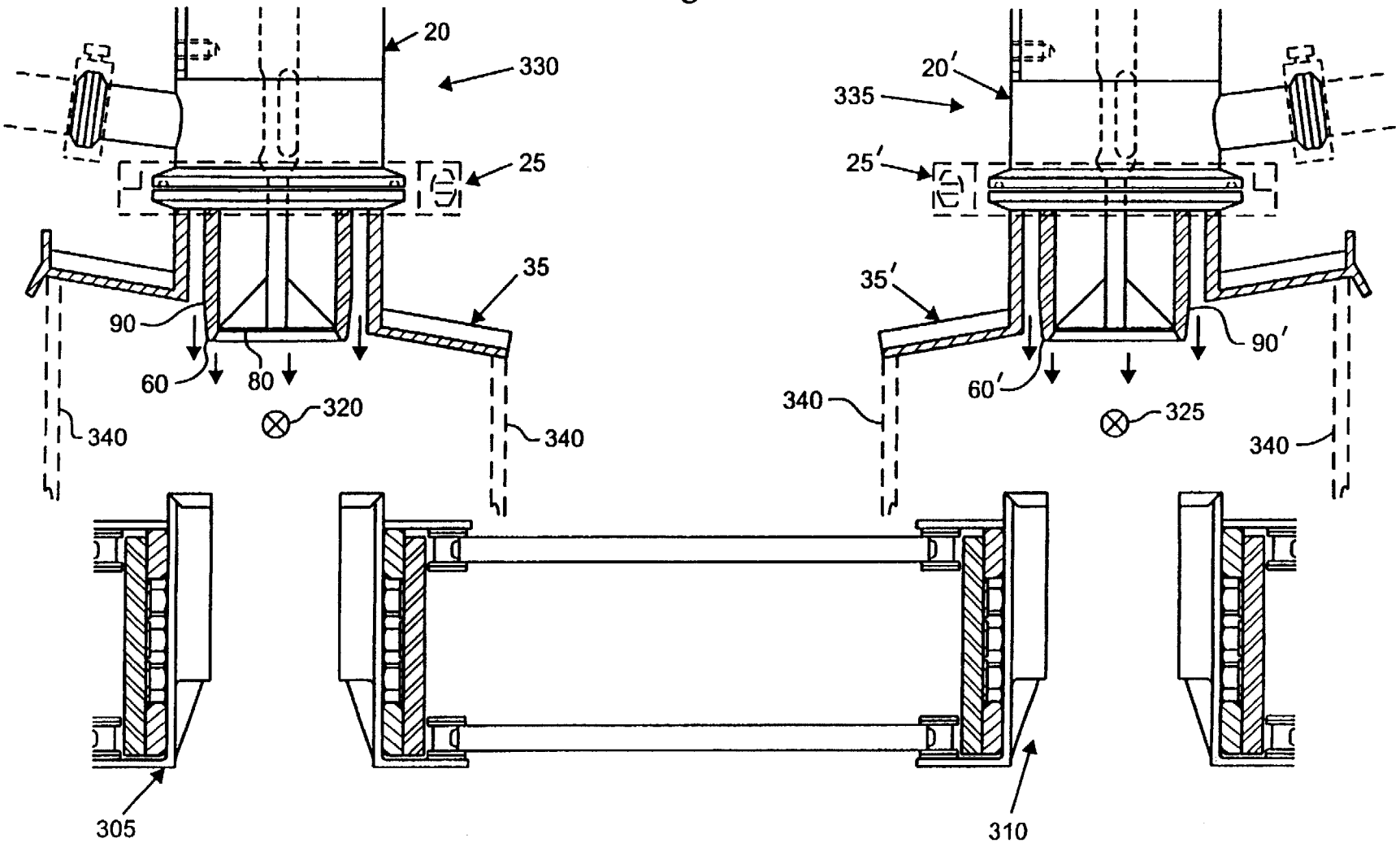
FIG. 16 illustrates a filling system for a filling machine wherein the filling system is configured for a production cycle of the machine in accordance with one embodiment of the present invention.

A two-line fill system, such as a system of a packaging machine of the type known as a TETRA MINI or TR/MINI available from Tetra Rex Packaging Systems, Inc., is illustrated in FIG. 16, with a pair of the presently described fill systems configured for a production cycle of the machine. During the production cycle, two conveyors 305, 310 transport containers, such as gabled-top containers, between successive processing stations of the filling machine. The conveyors 305,310 shuttle the containers in the direction denoted by axes 320 and 325. Containers are presented along each line, two at a time, for filling beneath the fill stations 330 and 335. Although only one fill valve assembly is shown for each of the fill stations 330 and 335, there are two such fill valve assemblies along each line.

The pair of fill valve housings 20 (only one shown) of each fill valve assembly associated with the first conveyor 305 are connected to a corresponding sanitary cover 35 while the pair of fill valve housings 20' (only one shown) of each fill valve assembly associated with the second conveyor 310 are connected to a corresponding sanitary cover 35'. More specifically, the flanges of the fill valve housings and the sanitary covers are joined by respective quick connect clamps 25 and 25'.

The sanitary covers 35, 35' assist in preventing condensation and debris from falling into the containers of each of the conveyor lines 305, 310. Accordingly, each of the sanitary covers 35, 35' are preferably angled toward a central portion of the machine as illustrated and may abut protective sidewalls 340 disposed on opposite sides of each conveyor line 305, 310. Such an arrangement facilitates draining of condensation toward, for example, a drain disposed at a central portion of the machine. The hygiene of the product and container are thus maintained and not compromised by foreign fluid or debris.

During the production cycle, a flow of sterile air, designated here by arrows proceeding downward about the nozzles 90, 90' is provided in the manner described in connection with FIG. 4. Additionally, when the valve plugs 80, 80' disengage from their respective valve seats 60,60', a flow of sterile air is provided along with the product thereby providing sanitary filling conditions. Sterile air is thus provided along the outside of the fill valve nozzle 90 and flows steady during the production cycle.

Figure 17:
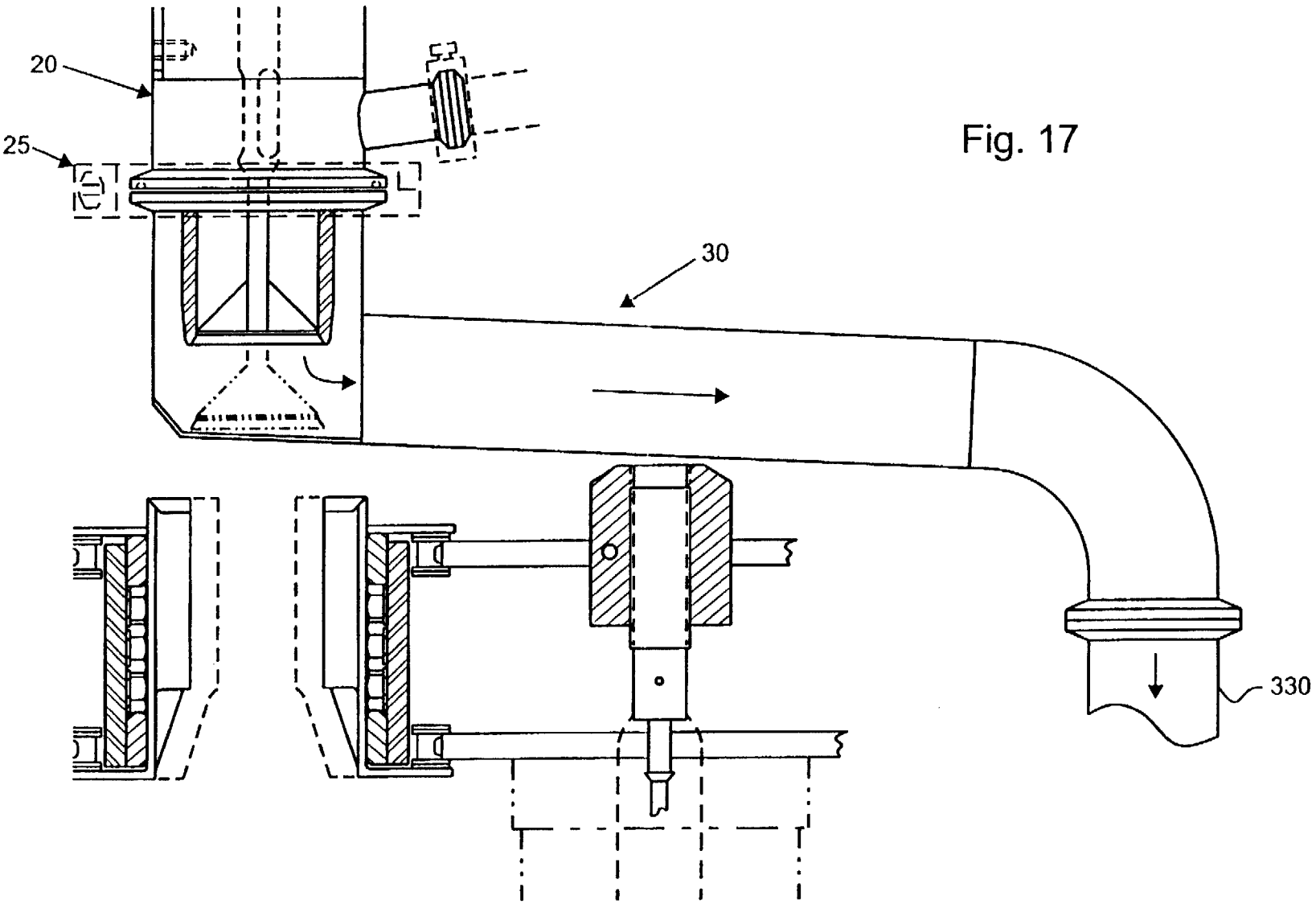
FIG. 17 illustrates a filling system for a filling machine wherein the filling system is configured for a clean-in-place cycle of the machine in accordance with one embodiment of the present invention.

FIG. 17 illustrates a single fill assembly of the foregoing packaging machine that has been configured for a clean-in-place cycle. In preparation for the clean-in-place cycle, the sanitary cover 35 has been removed and has been quickly and easily replaced by the clean-in-place manifold 30. More specifically, the flanges of the fill valve housing 20 and the clean-in-place manifold 30 are joined to one another by the quick-clamp mechanism 25, such as the tri-clamp described in connection with FIG. 15. As illustrated, the inlet 185 is of sufficient depth to allow the valve member to move between the open and closed positions shown.

Proper positioning of the manifold 30 is monitored by a sensor 341. The sensor 341 may be, for example, an infrared sensor that emits an infrared beam that is reflected off of a surface of the manifold 30. If the sensor detects a reflection of the infrared beam having a magnitude above a predetermined threshold value, it supplies an electronic output signal indicating that the manifold 30 is in place. The absence of a reflected infrared beam above the threshold value indicates that the manifold 30 is not properly positioned, and a corresponding output signal is provided. The output signal may be used to inhibit and/or start a clean-in-place cycle of the machine.

During a clean-in-place cycle, a cleaning solution is passed through the product inlet 50 as well as inlet 105 (see FIG. 4). Cleaning solution is thus allowed to pass through the aperture 75, flow channel 45, and channel 130 to clean and sanitize the surfaces of the components of the assembly. Fluids exiting the flow channel 45 and channel 130 enter the clean-in-place manifold 30 where they are directed to, for example, either a recirculation pipe or a drain, designated at 330 of FIG. 17.

Although the present invention has been described with reference to a specific embodiment, those of skill in the art will recognize that changes may be made thereto without departing from the scope and spirit of the invention as set forth in the appended claims.

I claim as my invention:

1. A filling system comprising:

a valve housing having a flow channel, an inlet to the flow channel, and an outlet from the flow channel, the valve housing having a flange extending therefrom about at least a portion of the periphery of the valve housing;

a valve member disposed in the valve housing for controlling fluid flow from the outlet of the valve housing;

a clean-in-place manifold having an inlet and an outlet, the manifold further having a flange disposed about at least a portion of the periphery of the inlet of the manifold;

a sanitary cover having a shield portion and a securement portion, the securement portion comprising a collar extending from the shield portion and a flange disposed about at least a portion of the periphery of the collar;

a tri-clamp having a groove disposed therein for alternately securing the flange of the clean-in-place manifold to the flange of the valve housing and the flange of the sanitary cover to the flange of the valve housing.

2. A filling system as claimed in claim 1 and further comprising a further inlet to the fluid channel, the further inlet connected to receive sterile gas from a sterile gas source.

3. A filling system as claimed in claim 1 wherein the fill valve housing comprises a valve seat portion, and wherein the valve member comprises:

a valve stem; and a valve plug disposed on the valve stem and adapted to seal with the valve seat of the fill valve housing.

4. A filling system as claimed in claim 1 wherein the fill valve housing further comprises:

a body portion;

a channel disposed about at least a portion of the body portion proximate the flange, the channel being open toward the outlet of the flow channel; and an inlet to the channel.

5. A filling system as claimed in claim 1 and further comprising a sensor disposed to detect the clean-in-place manifold when the manifold is secured to the valve housing.

6. A filling system as claimed in claim 5 wherein the sensor is an infrared emitter and detector mounted to detect reflected infrared emissions from a surface of the clean-in-place manifold.

7. A filling machine comprising:

a valve housing having a flow channel, an inlet to the flow channel, and an outlet from the flow channel, the valve housing having a flange extending therefrom about at least a portion of the periphery of the valve housing;

a product supply system providing a product to the inlet of the valve housing during production filling;

a clean-in-place system for providing a cleaning solution to the inlet of the valve housing during a clean-in-place operation;

a valve member disposed in the valve housing for controlling fluid flow from the outlet of the valve housing;

a clean-in-place manifold having an inlet and an outlet, the manifold further having a flange disposed about at least a portion of the periphery of the manifold;

a sanitary cover having a shield portion and a securement portion, the securement portion comprising a collar extending from the shield portion and a flange disposed about at least a portion of the periphery of the collar;

a tri-clamp having a groove disposed therein for securing the flange of the clean-in-place manifold to the flange of the valve housing when the filling machine undergoes a clean-in-place cycle and for securing the flange of the sanitary cover to the flange of the valve housing when the filling system is in a production cycle.

8. A filling machine as claimed in claim 7 and further comprising a sterile gas source connected to the second inlet of the fill valve housing.

9. A filling system as claimed in claim 7 wherein the fill valve housing further comprises:

a body portion;

a channel disposed about at least a portion of the body portion proximate the flange, the channel being open toward the outlet of the flow channel; and an inlet to the channel.

10. A filling system as claimed in claim 7 wherein the fill valve housing comprises a valve seat portion, and wherein the valve member comprises:

a valve stem; and a valve plug disposed on the valve stem and adapted to seal with the valve seat of the fill valve housing.

11. A filling system as claimed in claim 7 and further comprising a sensor disposed to detect the clean-in-place manifold when the manifold is secured to the valve housing.

12. A filling system as claimed in claim 10 wherein the sensor is an infrared emitter and detector mounted to detect reflected infrared emissions from a surface of the clean-in-place manifold.

13. A filling system as claimed in claim 2 wherein the sterile gas is air.

14. A filling system as claimed in claim 8 wherein the sterile gas source supplied sterile air.

* * * * *